United States Patent [19]

Ooms

[11] Patent Number: 4,547,301

[45] Date of Patent: Oct. 15, 1985

[54] SURFACTANT COMPOSITIONS

[75] Inventor: Julius Ooms, Langdorp, Belgium

[73] Assignee: The Procter & Gamble Company, Cincinnati, Ohio

[21] Appl. No.: 606,105

[22] Filed: May 2, 1984

[30] Foreign Application Priority Data

May 7, 1983 [GB] United Kingdom ..... 8312619

[51] Int. Cl.[4] ..... D06M 13/00

[52] U.S. Cl. ..... 252/8.8; 252/8.6; 252/8.75

[58] Field of Search ..... 427/242; 252/8.8, 8.75, 252/8.6, 8.9

[56] References Cited

U.S. PATENT DOCUMENTS

| | | | |
|---|---|---|---|
| 3,957,671 | 5/1976 | Sagel et al. | 252/142 |
| 4,126,562 | 11/1978 | Goffinet et al. | 252/8.8 |
| 4,149,978 | 4/1979 | Goffinet | 252/8.8 |
| 4,152,272 | 5/1979 | Young | 252/8.8 |
| 4,255,484 | 3/1981 | Stevens | 428/286 |
| 4,272,386 | 6/1981 | Draper, Jr. et al. | 252/8.6 |
| 4,422,949 | 12/1983 | Ooms | 252/8.8 |
| 4,447,343 | 5/1984 | May et al. | 252/8.75 |
| 4,454,049 | 6/1984 | Macgilp et al. | 252/8.8 |

*Primary Examiner*—Paul Lieberman
*Assistant Examiner*—Willie J. Thompson
*Attorney, Agent, or Firm*—Richard C. Witte; Ronald L. Hemingway

[57] ABSTRACT

Surfactant compositions suitable for use in textile treatment or detergent applications comprising a cationic surfactant having an endotherm melting completion temperature greater than 20° C., an aromatic adjunct having one or more acidic, hydroxylic or aldehydic substituents or an alkyl, alkenyl, aryl or alkaryl derivative thereof in the form respectively of an ester, ether or ketone, and optionally a non-aromatic solvent, a water-insoluble non-aromatic nonionic extender and an auxiliary cationic surfactant having an endotherm melting completion temperature of less than 20° C., wherein the cationic surfactant, aromatic adjunct, organic solvent, nonionic extender and auxiliary cationic surfactant, if present, constitute in total at least 70% by weight of composition. Preferred compositions are textile softeners suitable for use in automatic washing machine or automatic clothes dryer applications.

17 Claims, No Drawings

SURFACTANT COMPOSITIONS

TECHNICAL FIELD

This invention relates to surfactant compositions suitable for use in textile treatment or detergent applications. In preferred embodiments, the surfactant compositions are softener concentrates which are used directly for textile treatment, either in liquid form in the rinse cycle of a textile laundering operation or in solid form in an automatic clothes dryer. The softener concentrates can also be predispersed in water and used as conventional rinse-added aqueous softener compositions. In the case of liquid softener concentrates, the compositions combine excellent softening with improved water-dispersibility and storage characteristics after prolonged storage at both elevated and sub-normal temperatures. In the case of dryer-added concentrates, the compositions combine excellent softening with improved release from the dispensing substrate. In other embodiments, the surfactant compositions are used in the manufacture of granular or liquid detergent compositions with benefits in terms of improved physical and chemical stability, hygroscopicity, ease of processing etc.

BACKGROUND

Textile treatment compositions suitable for providing fabric softening and static control benefits during laundering are well known in the art and have found widespread commercial application. Conventionally, rinse-added fabric softening compositions contain, as the active component, substantially water-insoluble cationic materials having two long alkyl chains. Typical of such materials are di-hardened tallow dimethylammonium chloride and imidazolinium compounds substituted with two hardened tallow groups. These materials and normally prepared in the form of a dispersion in water and it is generally not possible to prepare such aqueous dispersions with more than about 6% of cationic softener without encountering severe product viscosity and storage-stability problems.

Although more concentrated dispersions of softener material can be prepared as described in EP-A No. 406 and GB-A No. 1,601,360 by incorporating certain nonionic adjunct softening materials therein, such compositions tend to be relatively inefficient in terms of softening benefit/unit weight of active; moreover, product viscosity and stability problems become increasingly unmanageable in more concentrated aqueous dispersions and effectively limit the commercial range of applicability to softener active levels in the range from about 15% to about 20%.

Cationic surfactant materials for textile treatment and detergency use are normally supplied by the manufacturer in the form of a slurry containing about 70%–80% of active material in an organic liquid such as isopropanol sometimes containing a minor amount of water (up to about 10%). Retail fabric softening compositions are then prepared by dispersion of the surfactant slurry in warm water under carefully controlled conditions. The physical form and dispersibility constraints of these industrial concentrates, however, are such as to preclude their direct use by the domestic consumer; indeed, they can pose severe processing problems even for the industrial supplier of retail fabric softening compositions.

In GB-A No. 2,007,734A, fabric softener concentrates are disclosed containing a mixture of a fatty quaternary ammonium salt having at least one $C_8$–$C_{30}$ alkyl substituent and an oil or substantially water-insoluble compound having oily/fatty properties. The concentrates are said to be easily dispersed/emulsified in cold water to form fabric softening compositions of adequate viscosity, thereby facilitating softener production by a manufacturer without the need for special mixing equipment. Applicants have found, however, that although these concentrates go some way towards alleviating the problems of the industrial manufacturer, the compositions are still highly deficient from the viewpoint of providing acceptable cold-water dispersibility, formulation stability at both elevated and sub-normal temperatures, together with satisfactory softening performance. As a result, the prior art compositions are essentially of limited value as retail compositions for direct use by the domestic consumer.

The present invention therefore provides a surfactant composition suitable for use in textile treatment in either liquid or solid form, liquid concentrates having improved stability at both elevated and sub-normal temperatures under prolonged storage conditions and good cold-water dispersibility in the dispenser of a domestic automatic washing machine together with excellent softening, anti-static and fabric rewettability characteristics across a broad range of fabric types. The invention also provides a textile conditioning composition in the form of an aqueous dispersion of the surfactant composition. The invention further provides a textile conditioning article incorporating the surfactant composition in combination with delivery means providing for release thereof in an automatic washing machine or an automatic clothes dryer. The invention still further provides detergent compositions prepared from or comprising the surfactant composition in solid or liquid form.

SUMMARY OF THE INVENTION

Accordingly, the present invention provides a surfactant composition comprising (a) from about 0.5% to about 99.5% of cationic surfactant having an endotherm melting completion temperature greater than about 20° C. and selected from di-$C_{12}$–$C_{24}$ alkyl and alkenyl amine, ammonium and quaternary ammonium surfactants, mono-$C_{12}$–$C_{24}$ alkyl and alkenyl amine and ammonium surfactants, mono- and di-$C_{12}$–$C_{24}$ alkyl and alkenyl imidazolinium surfactants and mixtures thereof, (b) from about 0.5% to about 75% of an aromatic adjunct having one or more acidic, hydroxylic or aldehydic substituents or an alkyl, alkenyl, aryl or alkaryl derivative thereof in the form respectively of an ester, ether or ketone, wherein the one or more substituent is attached directly to the aromatic nucleus or to a side chain thereof at no more than eight carbon atoms from the nucleus, (c) from 0% to about 99% of water-miscible non-aromatic organic solvent, (d) from 0% to about 45% of substantially water-insoluble non-aromatic, nonionic extender, and (e) from 0% to about 45% of auxiliary cationic surfactant having an endotherm melting completion temperature of less than about 20° C., wherein the cationic surfactant, aromatic adjunct, organic solvent, nonionic extender and auxiliary cationic surfactant, if present, constitute in total at least about 70% of the composition.

Suitable cationic surfactants herein can be defined according to their solid-liquid melting transition characteristics. It will be appreciated that typical commercial surfactants generally consist of a complex mixture of materials for which "melting point" as such becomes a poorly defined parameter. In the present development, therefore, the solid-liquid melting transition is monitored by thermal analysis using a differential scanning calorimeter (DSC) and the transition characterized by its endotherm "melting completion temperature". On this basis, the essential cationic surfactant component (sometimes herein referred to as high melting cationic surfactant) has an endotherm melting completion temperature of greater than about 20° C., preferably greater than about 30° C., more preferably greater than about 40° C. and especially greater than about 50° C. Such materials are highly desirable from the viewpoint of providing excellent softening and antistatic benefits in both rinse-added and automatic dryer applications.

Melting completion temperatures are determined herein by thermal analysis using a Du Pont 910 Differential Scanning Calorimeter with Mechanical Cooling Accessory and R90 Thermal Analyser as follows. A 5–10 mg sample of the softener material having a bound moisture content of 2%–5% and containing no free water or solvent, is encapsulated in a hermetically sealed pan with an empty pan as reference. The sample is initially heated until molten and then rapidly cooled (at about 20°–30° C./min) to −70° C. Thermal analysis is then carried out at a heating rate of 10° C./min using sufficient amplification of $\Delta T$ signal (i.e. temperature difference between sample and reference—vertical axis) to obtain an endotherm-peak signal:baseline noise ratio of better than 10:1. The melting completion temperature is then the temperature corresponding to the intersection of the tangential line at the steepest part of the endotherm curve at the high temperature end of the endotherm, with the horizontal line, parallel to the sample temperature axis, through the highest temperature endotherm peak.

In structural terms, the high melting cationic surfactant herein is selected from di-$C_{12}$–$C_{24}$ alkyl and alkenyl ammonium and quaternary ammonium surfactants, mono-$C_{12}$–$C_{24}$ alkyl and alkenyl ammonium surfactants, mono- and di-$C_{12}$–$C_{24}$ alkyl and alkenyl imidazolinium surfactants and mixtures thereof. Amine precursors of the above ammonium surfactants are also suitable herein. Preferred from the viewpoint of optimum storage stability, dispensing characteristics and textile conditioning performance, however, are the quaternary ammonium and ammonium surfactants and their amine precursors. A highly preferred class of cationic surfactants, therefore, has the general formula I.

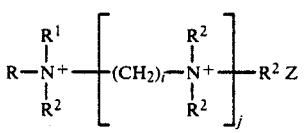

I or a non-protonated or partially protonated amine precursor thereof, wherein R is linear or branched $C_{12}$–$C_{24}$ alkyl or alkenyl, $R^1$ is linear or branched $C_{12}$–$C_{24}$ alkyl or alkenyl, $C_{1-4}$ alkyl or $-(C_nH_{2n}O)_mH$ and each $R^2$ is independently $C_{1-4}$ alkyl or $-(C_nH_{2n}O)_mH$, wherein i is from 1 to 6, preferably 2 or 3, j is from 0 to 9 preferably 0 or 1, n is 2 or 3 and m is from 0 to 15, preferably 0 to 9, the sum total of $C_nH_{2n}O$ groups in a molecule being no more than 25, preferably no more than 9 and wherein Z represents non-aromatic acid counterion in number to provide electrical neutrality, provided that when $R^1$ is $C_{1-4}$ alkyl or $-(C_nH_{2n}O)_mH$, at least one $R^2$ represents hydrogen.

Of the above, highly preferred are the substantially water-insoluble cationic surfactants having the general formula I in which $R^1$ is linear or branched $C_{12}$–$C_{24}$ alkyl or alkenyl, j is 0, each $R^2$ is $C_{1-4}$ alkyl, and Z is halide, methylsulfate or ethylsulfate. Representative examples of these water-insoluble surfactants include di-hydrogenated tallowalkyl dimethyl ammonium chloride; di-hydrogenated tallowalkyl dimethyl ammonium methyl sulfate; dihexadecyl dimethyl ammonium chloride; distearyl dimethyl ammonium chloride; dieicosyl dimethyl ammonium chloride; didocosyl dimethyl ammonium chloride; and dihexadecyl diethyl ammonium chloride. Of these, di(hydrogenated tallow alkyl) dimethyl ammonium chloride is preferred.

Also suitable herein are the water-soluble ammonium surfactants having the general formula I in which $R^1$ is $C_{1-4}$ alkyl or $-(C_nH_{2n}O)_mH$ and at least one $R^2$ is hydrogen. Again, the amine precursors of these surfactants are also highly suitable. Representative examples of these water-soluble surfactants include:

N-hardened tallowyl-N,N',N'-tris(2-hydroxyethyl)-1,3-propanediamine dihydrochloride and the corresponding free diamine;

N-stearyl-N,N'-di(2-hydroxyethyl)-N'-(3-hydroxypropyl)-1,3-propanediamine dihydrofluoride;

N-stearyl-N,N',N'-tris(3-hydroxypropyl)-1,3-propanediamine dihydrofluoride;

N-stearyl-N,N',N'-tris(2-hydroxyethyl)-N,N'-dimethyl-1,3-propanediammonium dimethylsulfate;

N-palmityl-N,N',N'-tris(3-hydroxypropyl)-1,3-propanediamine dihydrobromide;

N-hardened tallowyl-N-[N'',N''-bis(2-hydroxyethyl)-3-aminopropyl]-N',N'-bis(2-hydroxyethyl)-1,3-diaminopropane trihydrofluoride;

Ethoxylated (5 EO average) hardened tallow amine;

Ethoxylated (8 EO) stearylamine; and

Ethoxylated (2 EO) hardened tallow amine.

Water-soluble ammonium surfactants herein are preferably ethoxylated and contain from 2 to 9 moles of ethylene oxide per mole of amine. In preferred compositions of the liquid softener type, water-soluble surfactants are used in combination with water-insoluble cationic softener at a weight ratio of softener:water-soluble surfactant of at least about 1:1, more preferably at least about 3:1.

Another suitable class of cationic materials are the imidazolinium salts believed to have the formula:

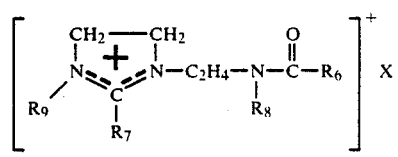

wherein $R_6$ is alkyl or alkenyl containing from 12 to 24 carbon atoms, $R_7$ is alkyl or alkenyl containing from 12 to 24 carbon atoms or alkyl containing from 1 to 4 carbon atoms, $R_8$ and $R_9$ are alkyl containing from 1 to 4 carbon atoms and X is the salt counter-anion, preferably a halide, methosulfate or ethosulfate. A suitable imidazolinium salt is 3-methyl-1-(hydrogenated tallowacylamido) ethyl-2-hydrogenated tallowalkyl-dihydroimidazolinium methosulfate. When present, high melting imidazolinium surfactants are preferably used in admixture with ammonium and quaternary ammonium surfactants at a weight ratio of total ammonium:imidazolinium surfactant of at least about 1:3.

The aromatic adjunct herein is characterized by one or more nuclear or side-chain acidic, hydroxylic or aldehydic substituents. In the case of side chain substituents, the acid, hydroxyl or aldehyde group is attached at a point no more than eight, preferably no more than four carbon atoms from the aromatic nucleus. Aromatic adjuncts wherein the substituent groups are alkyl, alkenyl, aryl or alkaryl derivatives of the above acidic, hydroxylic and aldehydic groups are also envisaged, such adjuncts being formally esters, ethers or ketones. The alkyl, alkenyl, aryl or alkaryl groups are optionally further substituted with atoms or radicals other than the essential substituent groups named above, for example, by halogen atoms. Importantly, all substituent groups, should be present, at least in part, in nonionic form. In particular, this means that acidic substituents are preferably present as free acid rather than in salt form. Where a combination of free acid and salt form substituents are present, the free acid preferably constitutes in molar terms at least about 25%, more preferably at least 50%, especially at least 90% of the mixture.

A preferred class of aromatic adjunct have the general formula II

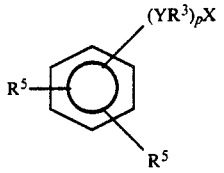

II wherein X is $OR^4$, $CO_2R^4$, $SO_3R^4$, or $(CO)R^4$, Y is O,NH or a direct bond, $R^3$ is $C_{1-2}$ alkylene or alkenylene, p is from 0 to 4, preferably from 0 to 2, $R^4$ is H or $C_{1-12}$ alkyl, alkenyl, aryl or alkaryl, and wherein each $R^5$ is independently selected from $(YR^3)_pX$, $C_{1-18}$ alkyl, alkenyl, aryl or alkaryl, halo, amino and $C_{1-4}$ alkyl substituted amino groups. Preferably, in the aromatic adjunct, nuclear substituted alkyl, alkylene or alkenylene groups total no more than about 20, more preferably no more than about 4 carbon atoms. Of course in the above formula, multiply-occurring symbols can represent the same or different specific atoms or groups.

The surfactant concentrates of the present invention can take the form of a solid complex of cationic surfactant and aromatic adjunct, or alternatively, can exist as a solution of cationic surfactant in organic solvent. Where the aromatic adjunct is an alcoholic solvent in its own right, for example, 2-phenoxyethanol, benzyl alcohol, 2-phenylethylalcohol, $C_{1-18}$ alkyl phenols ethoxylated with 2 moles of ethylene oxide, the concentrate can simply consist of a solution of cationic surfactant in aromatic adjunct. Where, on the other hand, the aromatic adjunct is solid under ambient conditions, concentrates in solution form may additionally contain a water-miscible non-aromatic organic solvent. The aromatic adjunct then effectively acts to increase the solubility of the cationic surfactant within the organic solvent. Preferred adjuncts of the acid, ester, ketone or phenol types which are normally solid at or close to ambient temperature include benzoic acid, m-chlorobenzoic acid, p-toluic acid, hydrocinnamic acid, salicylic acid, benzyl benzoate, benzyl salicylate, trichlorophenol, benzophenone, benzene sulfonic acid and $C_{1-18}$ alkyl benzene sulfonic acid. Notably, a combination of acidic adjunct on the one hand and an alcoholic aromatic solvent on the other hand is particularly effective in providing enhanced surfactant solubility and reduced compositional liquifaction point. In these embodiments, the weight ratio of acid to alcoholic solvent is generally from about 1:50 to about 10:1, preferably from about 1:20 to about 5:1.

Adjuncts of the acidic type are generally present in composition at a molar ratio with respect to high melting cationic surfactant of at least about 0.2:1, preferably from 0.3:1 to 2:1, more preferably from about 0.4:1 to about 1.5:1. These ratios are preferred from the viewpoint of providing optimum stability and liquifaction point. In terms of level, acidic adjuncts preferably constitute up to about 20% by weight of composition, more preferably from about 0.5% to about 15%. Aromatic adjuncts of the alcohol type, however, can be present in levels up to about 75% by weight, preferably from about 3% to about 35%.

The non-aromatic organic solvent component of the present compositions, when present, acts as a solvent for the cationic surfactant and for the aromatic adjunct and is also water-miscible. Preferred organic solvents have a dielectric constant at 20° C. of at least about 13, preferably at least about 17. The solvent is normally added at levels in excess of about 2%, preferably in excess of about 5%. Suitable organic solvents include mono- and polyhydric alcohols containing from one to ten carbon atoms, for example, ethanol, isopropanol, isobutanol, propylene glycol, propyleneglycol monomethyl or ethyl ether, 1,2-propane diol, 1-pentanol, 1-hexanol, hexylene glycol, glycerol, ethylene glycol, diethyleneglycol and diethyleneglycol monobutyl ether. In physical terms, such compositions generally exist in the form of homogeneous, isotropic solutions of cationic surfactant in organic solvent, the solutions being homogeneous and isotropic in the sense of being microscopically single phase as well as microscopically randomly orientated under polarized light (at 100× magnification).

A valuable benefit of the present invention is that compositions can be prepared as homogeneous, isotropic stable solutions even in admixture with substantial levels of water—up to 25% or even 30% in suitable instances. Preferably, water, if present, is added at a weight ratio of water:organic solvent of less than about 3.5:1, more preferably less than 3:1, especially less than 2.5:1.

The compositions herein in solution form can also be defined according to their liquifaction temperature, this being the temperature at which a sample of the composition begins to flow. Liquifaction temperature is measured as follows. A 1.5 g sample of molten composition is weighed into a glass cylindrical vial (internal diameter 23 mm, length 96 mm, wall thickness 1 mm). The sample is frozen at a temperature of −20° C. for 2 hours and the inverted vial is then immersed in water at a temperature of at least 10° C. below the approximate liquifaction temperature. The water is then heated with good agitation at a rate of 0.2° C./min and the liquifaction point is the temperature at which the sample begins to run down the tube. Preferred compositions herein have a liquifaction temperature of less than about 30° C., more preferably less than about 25° C., especially less than about 20° C. Highly preferred compositions have a liquifaction temperature of less than 15° C. Compared against a control composition containing no aromatic adjunct, the compositions of the invention preferably have a liquifaction temperature which is less by at least 5° C., more preferably at least 10° C., especially at least 15° C.

Another desirable, though optional component of the compositions of the invention is a substantially water-insoluble, non-aromatic, nonionic extender. In textile conditioning compositions the nonionic extender acts to enhance the softening performance of the composition. The nonionic extender is preferably selected from $C_{10}$–$C_{40}$, especially $C_{12}$–$C_{24}$ linear or branched hydrocarbons, and esters, especially the complete esters, of mono- or polyhydric alcohols with $C_8$–$C_{24}$, especially $C_{12}$–$C_{22}$ fatty acids.

Hydrocarbons suitable for use in the present invention are linear or branched paraffins or olefins especially those that are non-cyclic in character. Materials known generally as paraffin oil, soft paraffin wax and petrolatum are particularly suitable, especially paraffin oils derived from mineral sources such as petroleum. Examples of specific materials are tetradecane, hexadecane, octadecene and octadecane. Preferred commercially-available paraffin mixtures include spindle oil, light oil, refined white oils and technical grade mixtures of $C_{14}/C_{17}$ and $C_{18}/C_{20}$ n-paraffins.

The second class of nonionic extender is represented by fatty acid esters of mono- or polyhydric alcohols, highly preferred materials of this type being complete esters.

The mono- or polyhydric alcohol portion of the ester can be represented by methanol, isobutanol, 2-ethylhexanol, isononylalcohol, isooctyl alcohol, isopropanol, ethylene glycol, polyethylene glycols, glycerol, diglycerol, xylitol, sucrose, erythritol, pentaerythritol, sorbitol or sorbitan. Ethylene glycol, polyethylene glycol, sorbitan and glycerol esters are preferred. Highly preferred are sorbitan, glycerol and isononyl esters and their mixtures.

The fatty acid portion of the ester normally comprises a fatty acid having from 8 to 24 carbon atoms, typical examples being lauric acid, myristic acid, palmitic acid, stearic acid, oleic acid and behenic acid.

Highly preferred esters herein are glycerol trioleate sorbitan trioleate, ethoxylated sorbitan trioleate, methyl laurate, ethyl stearate, isopropyl myistate, isopropyl palmitate, iso-butyl stearate, isopropylstearate, isononylstearate, 2-ethylhexyl laurate and isooctyl myristate. Of the above, glycerol trioleate, sorbitan trioleate, isononylstearate and their mixtures are highly preferred.

In preferred embodiments, the nonionic extender is liquid at or close to normal temperature, highly suitable materials having a melting completion temperature (DSC) of less than about 25° C., preferably less than about 20° C. The viscosity of the liquid is preferably less than about 25 cp (0.025 Pa.s), more preferably less than about 15 cp (0.015 Pa.s) at 25° C.

When present, the nonionic extender is added in levels up to about 45% by weight of composition, preferably from about 3% to about 40%.

The textile softening compositions can also be complemented by auxiliary low melting point cationic surfactants especially the substantialy water-insoluble di-$C_{16}$–$C_{24}$ optionally hydroxy-substituted alkyl, alkaryl or alkenyl cationic fabric softeners having a melting completion temperature of less than 20° C. disclosed in European patent application No. 82305593. These include di-$C_{16}$–$C_{24}$ alkyl and/or alkenyl di-$C_1$–$C_4$ alkyl quaternary ammonium surfactants having an iodine value greater than about 40, preferably greater than about 55, e.g. dioleyldimethylammonium chloride; di-$C_{16}$–$C_{24}$ alkyl and/or alkenyl ammonium compounds having at least one $N(C_nH_{2n}O)_mH$ group and an iodine value greater than 20, preferably greater than 30, wherein n is 2 or 3 and m is from 1 to 15 provided that the total number of $C_nH_{2n}O$ groups is from 1 to 20, e.g. di-unhardened tallow alkyl hydroxypropyl methyl ammonium chloride, and di-$C_{16}$–$C_{24}$ alkyl and/or alkenyl imidazolinium surfactants having an iodine value greater than about 40, preferably greater than about 55, e.g. 3-methyl-1-(2-oleylacylamido)ethyl-2-oleylimidazolinium methosulphate. When present, the auxiliary cationic surfactant is added in levels of up to about 45% by weight of composition, preferably from about 5% to about 35%.

Stable compositions can be prepared according to the invention across a wide range of component levels. Thus, in the case of concentrated liquid textile softeners, compositions can be formulated delivering softening performance equivalent to that of a conventional (about 6%) aqueous fabric softener at either a small or large sub-multiple of current softener usage. In this respect the denominator (n) of the sub-multiple characterizes the concentrate as being of the nth degree of concentration.

In general, the compositions of the invention in solution form contain from about 0.5% to about 99.5%, preferably from about 10% to about 90% more preferably from about 12% to 70% of the high melting cationic surfactant, from about 0.5% to about 75%, preferably from about 5% to about 40%, more preferably from about 8% to about 30% of aromatic adjunct and up to about 99%, preferably from about 5% to about 85% of non-aromatic organic solvent, the total level of cationic surfactant, aromatic adjunct, organic solvent, nonionic extender and auxiliary cationic surfactant, if present, being such as to provide at least about 70%, preferably at least about 80% by weight of composition. In the case of compositions for textile softener use, however, preferred compositions have a relatively high degree of concentration (n being from about 7 to about 12) and contain a total of from about 30% to about 75% cationic surfactant (i.e. high melting+auxiliary cationic surfactant), from about 8% to about 30% aromatic adjunct, and up to about 45%, preferably from about 3% to about 40% of nonionic extender, the total level of high melting cationic surfactant, aromatic adjunct and nonionic extender, where present, forming preferably at least about 60%, more preferably at least about 70% by weight of composition.

The surfactant compositions of the invention in solid form can be prepared by comelting the cationic surfactant and aromatic adjunct or by precipitation of complex from a suitable solvent, for example acetonitrile, butan-2-one, dimethylformanide for mono-$C_{12}$–$C_{24}$ cationic surfactants and petroleum ether, dichloromethane and toluene for di-$C_{12}$–$C_{24}$ cationic surfactants. In solid compositions, the molar ratio of aromatic adjunct:high melting cationic surfactant is generally less than about 2:1, preferably about 1:1. Such compositions also preferably comprise less than about 5%, more preferably less than about 1% water.

The compositions herein can of course be complemented by other ingredients known for use in textile treatment and detergent compositions. Thus textile softeners can contain perfumes, perservatives, germicides, colorants, dyes, silicones, calcium chloride, fungicides, brighteners and opacifiers. These adjuvants, if used, are normally added at their conventional levels. However, in the case of composition ingredients utilized for a fabric treatment effect, eg perfumes, these materials can be added at higher than normal levels, corresponding to the degree of concentration of the product.

Textile conditioning articles for use in an automatic washing machine or an automatic clothes dryer can take the form of a pouch (eg an open pore polyurethane sponge pouch) or plastic bag releasably enclosing the surfactant concentrate either in liquid form (for washing machine application) or in solid form (for dryer application). A highly preferred article for dryer application, however, comprises the surfactant concentrate releasably affixed to a sheet of paper or woven or non-woven cloth substrate such that, at dryer operating temperatures, the surfactant concentrate is released from the substrate and deposits onto the fabric surfaces. Articles of this kind are fully disclosed in U.S. Pat. No. 3,442,692, Gaiser and U.S. Pat. No. 3,686,025, Morton.

The surfactant concentrates of the invention can also be added to liquid or solid detergent compositions for the purpose of providing additional textile treatment or detergency benefits. Such compositions will generally contain an anionic and/or nonionic organic surfactant component and can additionally comprise other usual components of detergent compositions such as detergency builders, soil suspending agents, fluorescers, enzymes, foam-suppressors, bleaches etc. A typical listing of these components is provided in European Patent Application No. 72166. In solid detergent compositions, the surfactant composition is normally added in particulate form; in liquid detergent compositions, the surfactant concentrate is simply dispersed into the remainder of the liquid vehicle.

The following examples illustrate the invention. In the Examples, the following abbreviations have been used:

| | |
|---|---|
| Ditallow dimethylammonium chloride ($T_c$ = 65° C.): | DTDMAC |
| N—Tallowyl-N,N',N'—tris(2-hydroxyethyl)-: 1,3-propanediamine, dihydrochloride | MTHPD |
| 3-Methyl-1-(2-oleylamido)ethyl:- 2-oleyl imidazolinium methosulfate ($T_c$ = 5° C.) | DOMI |
| 3-Methyl-1-(2-tallowacylamido)ethyl-: 2-tallowalkyl imidazolinium methosulfate ($T_c$ = 38° C.) | DTMI |
| Nonylphenol ethoxylated with 2 moles of: ethylene oxide | NP-2EO |
| Ethoxylated (5 EO) tallowamine: | TA5EO |
| $C_{11.8}$ Alkyl benzene sulfonic acid: | |
| $C_{20}$–$C_{24}$ branched paraffins (Witco: Carnation Oil) | Paraffin |

NB: DTDMAC, MTHPD and TA5EO are hardened tallow derivatives; DTMI is an unhardened tallow derivative $T_c$ indicates melting completion temperature.

EXAMPLES 1 TO X1

Softener compositions according to the invention are prepared as follows. The cationic surfactant materials are first heated to a temperature of from 45° C. to 65° C. until molten and the aromatic adjunct is then admixed to form a homogeneous liquid, any non-solvent aromatic adjunct materials being added prior to solvent aromatic adjunct materials. Nonionic extender and any remaining solvent materials are then added followed by the minor ingredients (perfumes, dyes etc.). Finally the compositions are cooled to ambient temperature.

| | I | II | III | IV | V | VI | VII | VIII | IX | X | XI |
|---|---|---|---|---|---|---|---|---|---|---|---|
| DTDMAC | 25 | 58 | 15 | 40 | 20 | 25 | 58 | 15 | 33 | 35 | 15 |
| DTMI | — | — | — | — | — | — | — | — | — | — | 15 |
| MTHPD | — | — | — | 5 | 6 | — | — | 4 | — | — | — |
| TA5EO | — | — | — | — | — | — | — | — | 7.5 | — | 7 |
| DOMI | 16 | — | 25 | — | 20 | 20 | — | 15 | — | — | — |
| Benzoic Acid | — | 10 | 1 | — | 3 | — | 10 | — | 6 | 6 | — |
| NP-2EO | 7 | — | — | — | — | — | — | — | — | — | — |
| Salicylic Acid | — | — | — | — | — | — | — | 2 | — | — | — |
| Hydrocinnamic Acid | 4 | — | — | — | — | — | — | — | — | — | — |
| Benzene sulfonic Acid | — | — | — | — | — | 7 | — | — | — | — | — |
| Benzophenone | — | — | — | — | — | 2 | — | — | — | — | — |
| 2-Phenoxyethanol | — | 13 | 10 | 15 | 23 | 8 | — | — | 10 | 20 | 20 |
| Benzyl Benzoate | — | — | — | — | — | — | — | 4 | — | — | — |
| Benzyl Alcohol | 5 | — | — | — | — | 2 | — | — | — | — | — |
| HLAS | — | — | — | 15 | — | — | — | — | — | — | — |
| Paraffin | 10 | — | 30 | 14 | 12 | 15 | — | 30 | 15 | 21 | — |
| Glyceryl Trioleate | 10 | — | — | — | — | — | — | — | — | — | — |
| Sorbitan Trioleate | 10 | — | — | — | — | — | — | — | — | — | — |
| Isononyl Stearate | — | — | — | — | — | — | — | — | — | — | 28 |
| Isopropyl Alcohol | 11 | 9 | 6 | 5 | 7 | 10 | 10 | 15 | 5 | 5 | — |
| Propylene Glycol | — | — | 5 | 5 | — | — | — | — | 13 | 5 | — |
| Polydimethylsiloxane | — | 2.5 | — | — | — | — | 2 | 2 | 2.5 | 2.5 | — |
| Water | 1 | 4 | 5 | — | 6 | 8 | 17 | 10 | 4.5 | 2.5 | 2 |
| Calcium Chloride | — | 0.5 | — | — | — | — | 0.25 | — | 0.5 | — | — |
| Dye, perfume & minors | 1 | 3 | 3 | 1 | 3 | 3 | 2.75 | 3 | 3 | 3 | 3 |

The above softener compositions have improved stability at both elevated and sub-normal temperatures under prolonged storage conditions and good cold-water dispersibility in the dispenser of a domestic automatic washing machine together with excellent softening, antistatic and fabric rewettability characteristics across a broad range of fabric types.

What is claimed is:

1. A surfactant composition for use in detergency or textile treatment comprising:

(a) from about 10% to about 90% of cationic surfactant having an endotherm melting completion temperature greater than about 20° C. and selected from the group consisting of di-$C_{12}$–$C_{24}$ alkyl and alkenyl amine, ammonium and quaternary ammonium surfactants, mono-$C_{12}$–$C_{24}$ alkyl and alkenyl amine and ammonium surfactants, mono- and di-$C_{12}$–$C_{24}$ alkyl and alkenyl imidazolinium surfactants and mixtures thereof, (b) from about 5% to about 40% of an aromatic adjunct selected from compounds having the formula

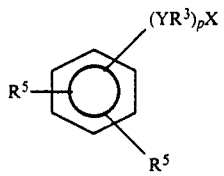

wherein X is $CO_2R^4$, $SO_3R^4$, or $(CO)R^4$, Y is O,NH or a direct bond, $R^3$ is $C_{1-2}$ alkylene or alkenylene, p is from 0 to 4, $R^4$ is H or $C_{1-12}$ alkyl, alkenyl, aryl or alkaryl, and wherein each $R^5$ is independently selected from $(YR^3)_pX$, $C_{1-18}$ alkyl, alkenyl, aryl or alkaryl, halo, amino and $C_{1-4}$ alkyl substituted amino groups, (c) from 0% to about 85% of water-miscible non-aromatic organic solvent, (d) from 0% to about 45% of substantially water-insoluble non-aromatic, nonionic extender, and (e) from 0% to about 45% of auxiliary cationic surfactant having an endotherm melting completion temperature of less than about 20° C., wherein the cationic surfactant, aromatic adjunct, organic solvent, nonionic extender and auxiliary cationic surfactant, if present, constitute in total at least about 70% of the composition.

2. A composition according to claim 1 wherein the high melting cationic surfactant is selected from compounds having the general formula I

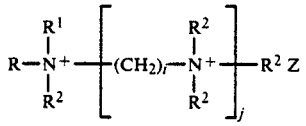

I and non-protonated and partially protonated amine precursors thereof, wherein R is linear or branched $C_{12}$–$C_{24}$ alkyl or alkenyl, $R^1$ is linear or branched $C_{12}$–$C_{24}$ alkyl or alkenyl $C_{1-4}$ alkyl or $-(C_nH_{2n}O)_mH$ and each R is independently $C_{1-4}$ alkyl or $-(C_nH_{2n}O)_mH$ wherein i is from 1 to 6, preferably 2 or 3, j is from 0 to 9 preferably 0 or 1 n is 2 or 3 and m is from 0 to 15, preferably 0 to 9, the sum total of $C_nH_{2n}O$ groups in a molecule being no more than 25, preferably no more than 9 and wherein Z represents non-aromatic acid counterion in number to provide electrical neutrality, provided that when $R^1$ is $C_{1-4}$ alkyl or $-(C_nH_{2n}O)_mH$, at least one $R^2$ represents hydrogen.

3. A composition according to claim 2 wherein the aromatic adjunct is an acid, ester, or ketone selected from the group consisting of benzoic acid, m-chlorobenzoic acid, p-toluic acid, hydrocinnamic acid, benzyl benzoate, benzophenone, benzenesulfonic acid and $C_1$–$C_{18}$ alkyl benzenesulfonic acid.

4. A composition according to claim 2 wherein the aromatic adjunct comprises an aromatic acid wherein the molar ratio of aromatic acid:high melting cationic surfactant is at least about 0.2:1.

5. A composition according to claim 2 additionally comprising from about 1% to 25% water.

6. A composition according to claim 1 comprising from about 10% to about 90% of high melting cationic surfactant, from about 5% to about 40% of aromatic adjunct and from about 5% to about 85% of non-aromatic organic solvent.

7. A composition according to claim 6 wherein the high melting cationic surfactant is selected from:

(a) substantially water-insoluble cationic surfactant having the general formula I in which $R^1$ is linear or branched $C_{12}$–$C_{24}$ alkyl or alkenyl and each $R^2$ is $C_{1-4}$ alkyl, (b) water-soluble cationic surfactant having the general formula I in which $R^1$ is $C_{1-4}$ alkyl or $-(C_nH_{2n}O)_mH$, and at least one $R^2$ is hydrogen, or an amine precursor thereof, and (c) mixtures thereof.

8. A composition according to claim 7 comprising from about 3% to about 40% of substantially water-insoluble nonionic extender selected from the group consisting of $C_{10}$–$C_{40}$ linear and branched hydrocarbons and esters of mono- and polyhydric alcohols with $C_{12}$–$C_{24}$ fatty acids.

9. A composition according to claim 2 wherein the auxiliary cationic surfactant is selected from the group consisting of di-$C_{16}$–$C_{24}$ alkyl and alkenyl di $C_{1-4}$ alkyl quaternary ammonium surfactants having an iodine value greater than about 40, di-$C_{16}$–$C_{24}$ alkyl and alkenyl ammonium compounds having at least one $N(C_nH_{2n}O)_mH$ group and an iodine value greater than about 20 wherein n is 2 or 3 and m is from 1 to 15 provided that the total number of $C_nH_{2n}O$ groups is from 1 to 20, and di-$C_{16}$–$C_{24}$ alkyl and/or alkenyl imidazolinium surfactants having an iodine value greater than about 40.

10. A composition according to claim 2 wherein the cationic surfactant has a melting completion temperature of at least about 40° C., the composition being characterized by a liquifaction temperature of less than about 30° C.

11. A surfactant composition for use in detergency or textile treatment comprising:

(a) from 10% to 90% of a cationic surfactant having an endotherm melting completion temperature greater than about 40° C. and (b) from about 5% to about 40% of an aromatic adjunct having the formula

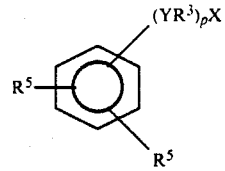

wherein X is $CO_2R^4$, $SO_3R^4$, or $(CO)R^4$, Y is O,NH or a direct bond, $R^3$ is $C_{1-2}$ alkylene or alkenylene, p is from 0 to 4, $R^4$ is H or $C_{1-12}$ alkyl, alkenyl, aryl or alkaryl, and wherein each $R^5$ is independently selected from $(YR^3)_pX$, $C_{1-18}$ alkyl, alkenyl, aryl or alkaryl, halo, amino and $C_{1-4}$ alkyl substituted amino groups; and (c) from 5% to 85% of a non-aromatic organic solvent; wherein the composition is in the form of an isotropic surfactant solution having a liquifaction temperature of less than 25° C.

12. A textile conditioning article for use in automatic washing machines or automatic clothes dryers comprising the surfactant composition of claim 1 in combination with delivery means providing for release thereof within the washing machine or dryer respectively.

13. The composition according to claim 4 wherein the molar ratio of aromatic acid:high melting cationic surfactant is from about 0.4:1 to about 1.5:1.

14. The composition according to claim 10 wherein said composition is characterized by a liquifaction temperature of less than about 20° C.

15. The composition according to claim 10 wherein said composition is characterized by a liquifaction temperature of less than about 15° C.

16. The composition according to claim 11 wherein the liquifaction temperature is less than 20° C.

17. The composition according to claim 11 wherein the liquifaction temperature is less than 15° C.

* * * * *

UNITED STATES PATENT AND TRADEMARK OFFICE

CERTIFICATE OF CORRECTION

PATENT NO. : 4,547,301 Page 1 of 2

DATED : October 15, 1985

INVENTOR(S) : Julius Ooms

It is certified that error appears in the above-identified patent and that said Letters Patent are hereby corrected as shown below:

Col. 4, lines 55-64 the formula:

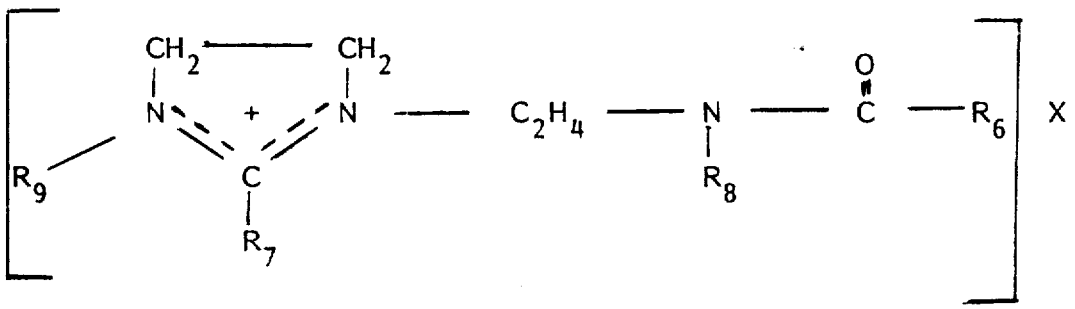

should read --

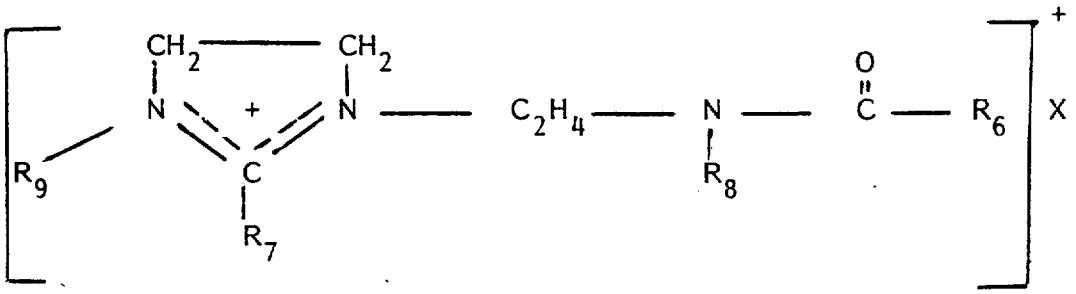

--

UNITED STATES PATENT AND TRADEMARK OFFICE

CERTIFICATE OF CORRECTION

PATENT NO. : 4,547,301

DATED : October 15, 1985

INVENTOR(S) : Julius Ooms

It is certified that error appears in the above-identified patent and that said Letters Patent are hereby corrected as shown below:

Col. 9, line 57, across from "$C_{11.8}$ Alkyl benzene sulfonic acid:" insert -- HLAS --.

Col. 10, line 14, on the line for "Benzoic Acid" under example "XI" insert -- 7 --.

IN THE CLAIMS:

Col. 11, line 43, delete "R" and insert therefor -- $R^2$ --.

Signed and Sealed this

*Third* Day of *June 1986*

[SEAL]

*Attest:*

DONALD J. QUIGG

*Attesting Officer*

*Commissioner of Patents and Trademarks*